US011939821B2

(12) United States Patent
Bauer

(10) Patent No.: US 11,939,821 B2
(45) Date of Patent: Mar. 26, 2024

(54) KELLY BAR ARRANGEMENT FOR A DRILLING APPARATUS AND METHOD FOR WORKING THE GROUND

(71) Applicant: BAUER Maschinen GmbH, Schrobenhausen (DE)

(72) Inventor: Sebastian Bauer, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 17/595,466

(22) PCT Filed: Aug. 4, 2020

(86) PCT No.: PCT/EP2020/071850
§ 371 (c)(1),
(2) Date: Nov. 17, 2021

(87) PCT Pub. No.: WO2021/032461
PCT Pub. Date: Feb. 25, 2021

(65) Prior Publication Data

US 2022/0220814 A1 Jul. 14, 2022

(30) Foreign Application Priority Data

Aug. 16, 2019 (EP) ..... 19192058

(51) Int. Cl.
*E21B 17/07* (2006.01)
*E21B 7/02* (2006.01)

(52) U.S. Cl.
CPC ..... *E21B 17/07* (2013.01); *E21B 7/02* (2013.01)

(58) Field of Classification Search
CPC ..... E21B 17/07; E21B 7/02
See application file for complete search history.

(56) References Cited

U.S. PATENT DOCUMENTS 5,501,287 A 3/1996 Loeser
2001/0048854 A1* 12/2001 Carter, Jr. ..... E02D 5/46 52/742.16

(Continued)

FOREIGN PATENT DOCUMENTS

DE 43 33 114 C1 10/1994
EP 2 821 585 A1 1/2015
EP 3 228 756 A1 10/2017

OTHER PUBLICATIONS

Written Opinion mailed by Intellectual Property Office of Singapore dated Oct. 12, 2022 , which corresponds to Singaporean Application No. 10202111447Y and is related to U.S. Appl. No. 17/595,466.

(Continued)

*Primary Examiner* — Taras P Bemko
(74) *Attorney, Agent, or Firm* — Studebaker & Brackett PC

(57) ABSTRACT

The present application relates to a Kelly bar arrangement for a drilling apparatus and a method for working the ground with the drilling apparatus. The arrangement includes a tubular outer Kelly bar and an inner Kelly bar which is displaceably supported inside the outer Kelly bar and has a rope suspension. The drilling torque can be transmitted between the outer Kelly bar and the inner Kelly bar. At least one line is arranged on the inner Kelly bar. A rotary feedthrough with a first attachment section and a second attachment section is arranged in a lower or upper end region of the inner Kelly bar. The rotary feedthrough includes a rotary device arranged for actively rotating the two attachment sections relative to each other.

11 Claims, 4 Drawing Sheets

(56) References Cited

U.S. PATENT DOCUMENTS

Figure 1:
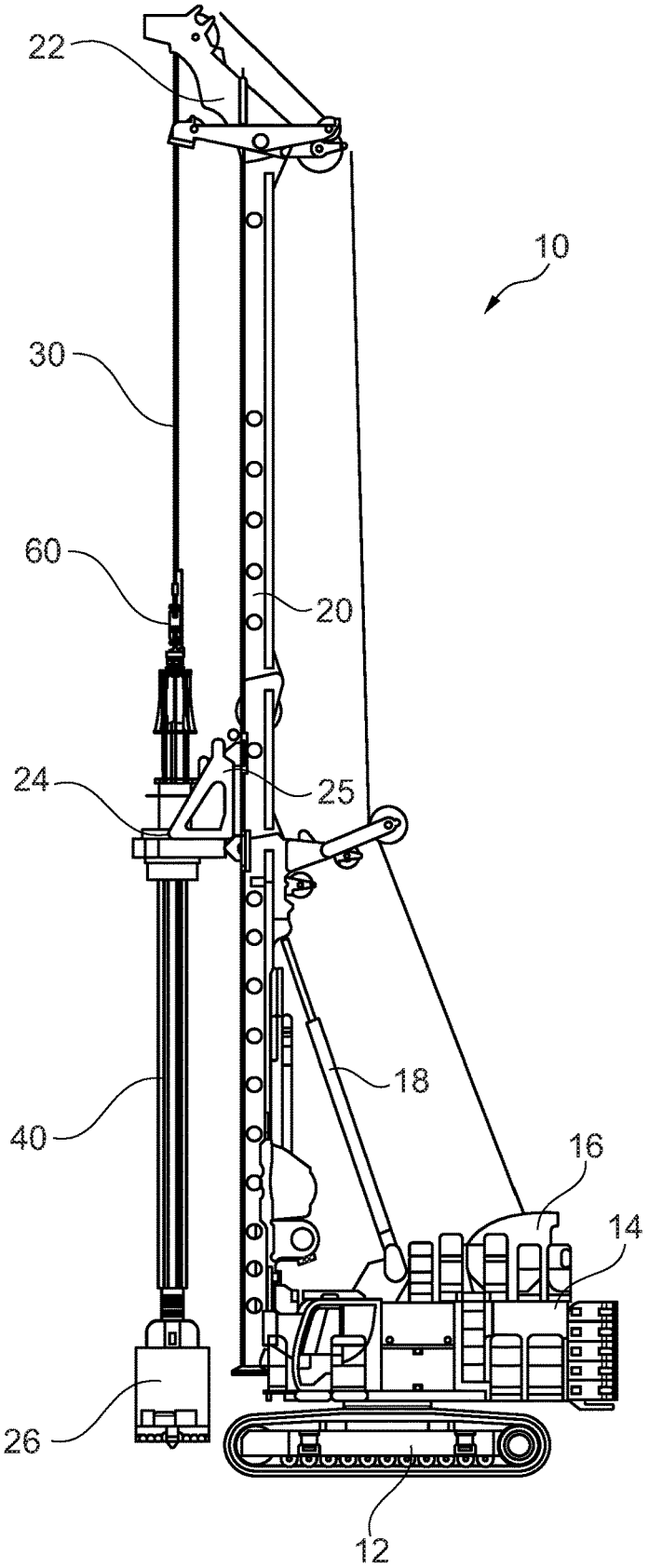

| | | | | |
|---|---|---|---|---|
| 2004/0173383 | A1* | 9/2004 | Hollingsworth | E21B 10/64 175/323 |
| 2011/0048805 | A1* | 3/2011 | Bauer | E02D 7/22 175/57 |
| 2011/0105235 | A1* | 5/2011 | Krollmann | E21B 17/07 464/92 |
| 2012/0186882 | A1* | 7/2012 | Biserna | E21B 7/023 175/220 |
| 2015/0008040 | A1 | 1/2015 | Wiedenmann | |
| 2017/0191313 | A1* | 7/2017 | Biserna | E21B 7/02 |
| 2017/0284162 | A1 | 10/2017 | Schober et al. | |

OTHER PUBLICATIONS

International Preliminary Report on Patentability (Chapter II) issued in PCT/EP2020/071850; completed Mar. 5, 2021.

International Search Report issued in PCT/EP2020/071850; dated Oct. 7, 2020.

An Office Action mailed by the Canadian Intellectual Property Office dated Jan. 12, 2023, which corresponds to Canadian Patent Application No. 3,138,200 and is related to U.S. Appl. No. 17/595,466.

* cited by examiner

KELLY BAR ARRANGEMENT FOR A DRILLING APPARATUS AND METHOD FOR WORKING THE GROUND

The invention relates to a Kelly bar arrangement for a drilling apparatus, in particular an earth drilling apparatus, with a tubular outer Kelly bar, which is designed for bearing on a drill drive and for receiving a drilling torque of the drill drive, and with an inner Kelly bar, which is displaceably supported inside the outer Kelly bar and has a rope suspension, wherein the drilling torque can be transmitted between the outer Kelly bar and the inner Kelly bar.

A generic Kelly bar arrangement in accordance with the preamble is known from DE4333114 C1.

Furthermore, the invention relates to a method for working the ground, in which a Kelly bar arrangement is set into rotating motion by means of a drill drive, wherein on an inner Kelly bar of the Kelly bar arrangement a ground working tool is mounted which works a ground.

Kelly bar arrangements for a drilling apparatus have been known for a long time in specialist foundation engineering. Such Kelly bar arrangements are telescopic and have an external outer Kelly bar which is in rotational connection with a drill drive of the drilling apparatus. Inside the outer Kelly bar an inner Kelly bar and, as the case may be, further intermediate Kelly bars are arranged which are supported in an axially displaceable manner in the outer Kelly bar and with respect to each other. The inner Kelly bar has a rope suspension so that the inner Kelly bar as well as the entire Kelly bar arrangement can be held and moved vertically on the rope.

For the torque transmission provision is made on the respective external and internal sides of the individual Kelly bar elements for axially running abutment strips which permit both an axial movement and a torque transmission in the circumferential direction.

Such a Kelly bar arrangement allows for an efficient rope suspension of a ground working tool while at the same time providing the possibility of a torque transmission. Moreover, the telescopic capability of the individual Kelly bar elements with respect to each other renders it possible to reach working depths that are greater than a height of the mast of a drilling apparatus.

Such Kelly bar arrangements are used for operations with simple mechanical ground working tools, as for example a drilling bucket or a drilling auger. The use of a Kelly bar arrangement becomes problematic if a medium, such as a flushing liquid or a pressurized fluid, is to be supplied from the outside.

The invention is based on the object to provide a Kelly bar arrangement and a method for working the ground with a Kelly bar arrangement which are particularly versatile in use.

In accordance with the invention the object is achieved on the one hand by a Kelly bar arrangement and on the other hand by a method. Preferred embodiments are stated in the dependent claims.

The Kelly bar arrangement according to the invention is characterized in that on the inner Kelly bar at least one line is arranged, in that in a lower or upper end region of the inner Kelly bar a rotary feedthrough with a first attachment section and a second attachment section is arranged, wherein the first attachment section is connected in a torque-proof manner to the rotationally drivable Kelly bar and forms a line connection to the at least one line of the inner Kelly bar and the second attachment section is connected to a supply line which is stationary relative to the rotationally drivable inner Kelly bar, and in that on the rotary feedthrough a rotary means is arranged for actively rotating the two attachment sections relative to each other.

A first aspect of the invention resides in the fact that on the inner Kelly bar a rotary feedthrough is provided. A rotary feedthrough is an element that allows a line connection between a rotating part and a part that is stationary relative thereto. This rotary feedthrough can be arranged in a lower or upper end region of the inner Kelly bar. Preferably, along the inner Kelly bar at least one line is provided which leads from the upper end region to a lower region of the Kelly bar. Alternatively, the rotary feedthrough is arranged in a lower end region of the inner Kelly bar, in which case the line co-rotating with the inner Kelly bar can be of correspondingly shorter length. On the other hand, the relatively stationary supply line can be guided inside the internal hollow space of the inner Kelly bar from the top to the second attachment section of the rotary feedthrough in the lower end region.

According to a further aspect of the invention a rotary means for actively rotating the two attachment sections relative to each other is arranged on the rotary feedthrough. The invention is based on the realization that e.g. when the Kelly bar arrangement is telescoped outwards the upper end of the inner Kelly bar can be moved up to a lower end region of the outer Kelly bar. Thus, a necessary reliable mechanical support of the rotary feedthrough with respect to a part that is stationary relative to the rotating Kelly bar arrangement is rendered practically impossible. There is a risk that the supply line co-rotates with the rotating inner Kelly bar.

To prevent an undesirable rotation of the stationary supply line, which is guided e.g. from the drilling apparatus to the rotary feedthrough on the inner Kelly bar, around the rope with which the inner Kelly bar is suspended a rotary means is provided for actively rotating the two attachment sections relative to each other. Through this, an undesirable winding of the supply line around the rope can be counteracted in a targeted manner.

In this way, a Kelly bar arrangement with the advantageous rope suspension and the telescopic capability with simultaneous torque transmission can also be used for ground working tools, in which the supply of a fluid, energy or data is necessary or desired via a supply line from the outside.

Basically, the rotary feedthrough can be arranged at any position in the upper end region of the inner Kelly bar. According to an embodiment variant of the invention it is particularly advantageous for the rotary feedthrough to be arranged on the inner Kelly bar below the rope suspension. Here, the rotary feedthrough can be of ring-shaped design, thus allowing the rope suspension to be arranged in a center region of the rotary feedthrough.

Another preferred embodiment of the invention resides in the fact that the rotary means has at least a drive motor for actively rotating the second attachment section relative to the first attachment section. Basically, further drive motors can also be provided.

In conjunction with this it is particularly preferred that the drive motor is arranged on the second attachment section which lies above the first attachment section. This provides a good accessibility to the drive motor. Moreover, an energy supply to the drive motor can take place parallelly or by way of the supply line.

For a compact construction it is generally advantageous for the drive motor to be an electric motor or a hydraulic motor. The drive motor as a whole can be of very compact design since the necessary compensation of the rotating motion between the two attachment sections only requires an application of relatively low torques. Basically, a compressed air motor can be provided too.

Another advantageous embodiment of the invention resides in the fact that the rope suspension has a rope swivel. Within the meaning of the invention a rope swivel is a rotary joint that allows rotatability of a lower linkage of the rope swivel to the inner Kelly bar with respect to an upper linkage of the rope swivel to the suspension rope. A rope swivel can ensure that a rotating motion of the inner Kelly bar, which is suspended on the lower linkage of the rope swivel, cannot be transmitted to the upper part of the rope swivel and thus to the rest of the rope. In this way, a twisting of the suspension rope can be reliably prevented.

Basically, the line of the inner Kelly bar can be designed as a hollow line, e.g. a hose or a tube or as a cable for conducting electricity or data. According to a further development of the invention it is particularly expedient that as a line an axial hollow space of the inner Kelly bar is provided which is designed for passing a fluid through. The fluid can in particular be a flushing liquid or a concrete suspension. At the lower end of the inner Kelly bar an attachment region can be provided, with which a line attachment to a ground working tool, more particularly a drilling tool mounted at the lower end of the inner Kelly bar is rendered possible.

Furthermore, according to an embodiment variant of the invention it is preferred that as a line on the inner Kelly bar a cable is provided which is designed for conducting electricity and/or data. Here, the cable can be guided as an additional line along the axial hollow space of the inner Kelly bar. When conducting electricity or data the rotary feedthrough is designed by itself or additionally with corresponding contact rings on both attachment sections, which ensure a frictional contact for electricity or data transmission during a rotating motion.

Furthermore, the invention comprises a drilling apparatus, in particular an earth drilling apparatus, with a drill drive, wherein the previously described Kelly bar arrangement according to the invention is provided. The drill drive is preferably of ring-shaped design with a passage, through which the outer Kelly bar of the Kelly bar arrangement is guided. Here, the ring-shaped rotary drive has a ring-shaped drive wheel which is provided with drive protrusions on its internal side. For the torque transmission these interact in a known manner with axial drive strips on the external side of the outer Kelly bar.

Basically, in a simple embodiment of the Kelly bar arrangement only an outer Kelly bar and an inner Kelly bar can be provided. However, between the outer Kelly bar and the inner Kelly bar one or several intermediate Kelly bar elements can also be arranged, whereby the respective maximum telescopic length of the Kelly bar arrangement is increased accordingly.

According to the invention it is especially preferred that a control is provided for the rotary means and that a rotation detector is provided for determining a rotational speed and/or a direction of rotation at least of the inner Kelly bar, which is in signal connection with the control. By way of the control the rotary means and thus the drive motor can always be actuated such that the upper second attachment section of the rotary feedthrough is stationary as far as possible relative to the rotating inner Kelly bar.

According to a further development of the invention it is especially preferred that the rotary means is driven in a controlled manner by the control means such that the second attachment section of the rotary feedthrough is driven and synchronized in a diametrically opposed manner to a rotating motion of the inner Kelly bar. Thus, an exact compensation of the rotating motion of the inner Kelly bar takes place so that through the diametrically opposed rotating motion by the rotary means a desired standstill of the second attachment section with the supply line is brought about which can basically also be a fluid line and/or a cable.

The method for working the ground according to the invention which can in particular be carried out with the previously described drilling apparatus is characterized in that a rotary means is provided for actively rotating the second attachment section relative to the first attachment section, wherein the second attachment section is operated in a diametrically opposed manner to a rotating motion of the inner Kelly bar.

Hence, with the method a complete or extensive standstill of the second attachment section, on which the upper supply line is mounted, relative to the rotating first attachment section on the inner Kelly bar can be achieved without there being the need for elaborate mechanical supports or the risk of twisting of the support rope or winding of the supply line around the support rope.

The method is carried out with the previously described Kelly bar arrangement according to the invention.

According to a further development of the invention a particularly precise matching of the rotating motion can be accomplished in that the rotary means is operated depending on the rotational speed of the inner Kelly bar or the drill drive. A rotational speed setting of the drill drive can be directly used as a preset for the rotary means. Alternatively, the rotational speed of the inner Kelly bar or the drill drive can be detected by a rotation detector and used to control the rotary means.

Figure 2:
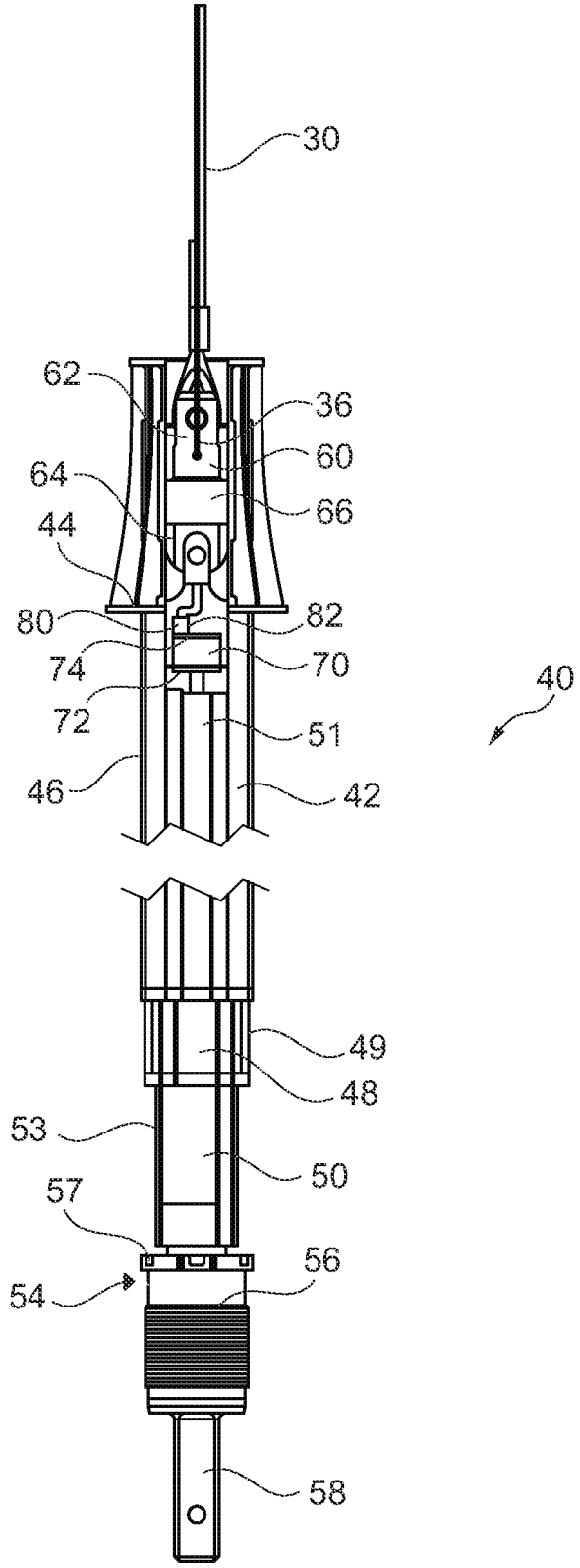
Figure 3:
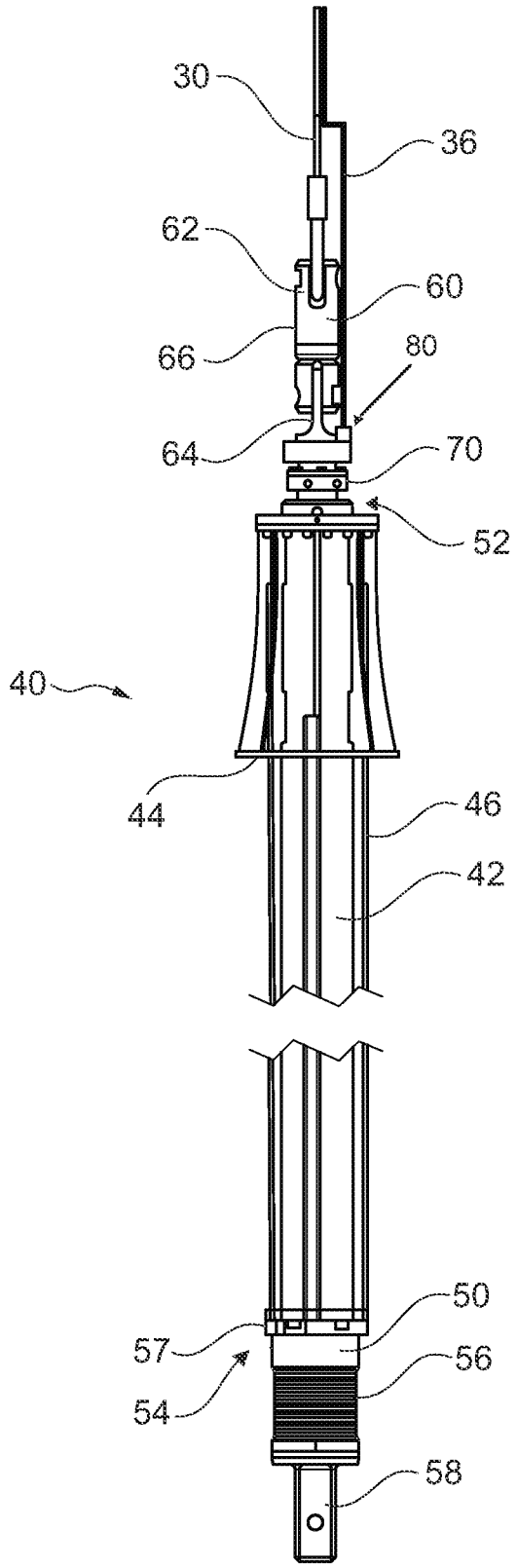

The invention is described further hereinafter by way of a preferred exemplary embodiment illustrated schematically in the drawings, wherein show:

FIG. 1 a side view of a drilling apparatus with a Kelly bar arrangement according to the invention;

FIG. 2 a Kelly bar arrangement according to the invention in a partially extended state;

FIG. 3 the Kelly bar arrangement of FIG. 2 in a retracted state, and

Figure 4:
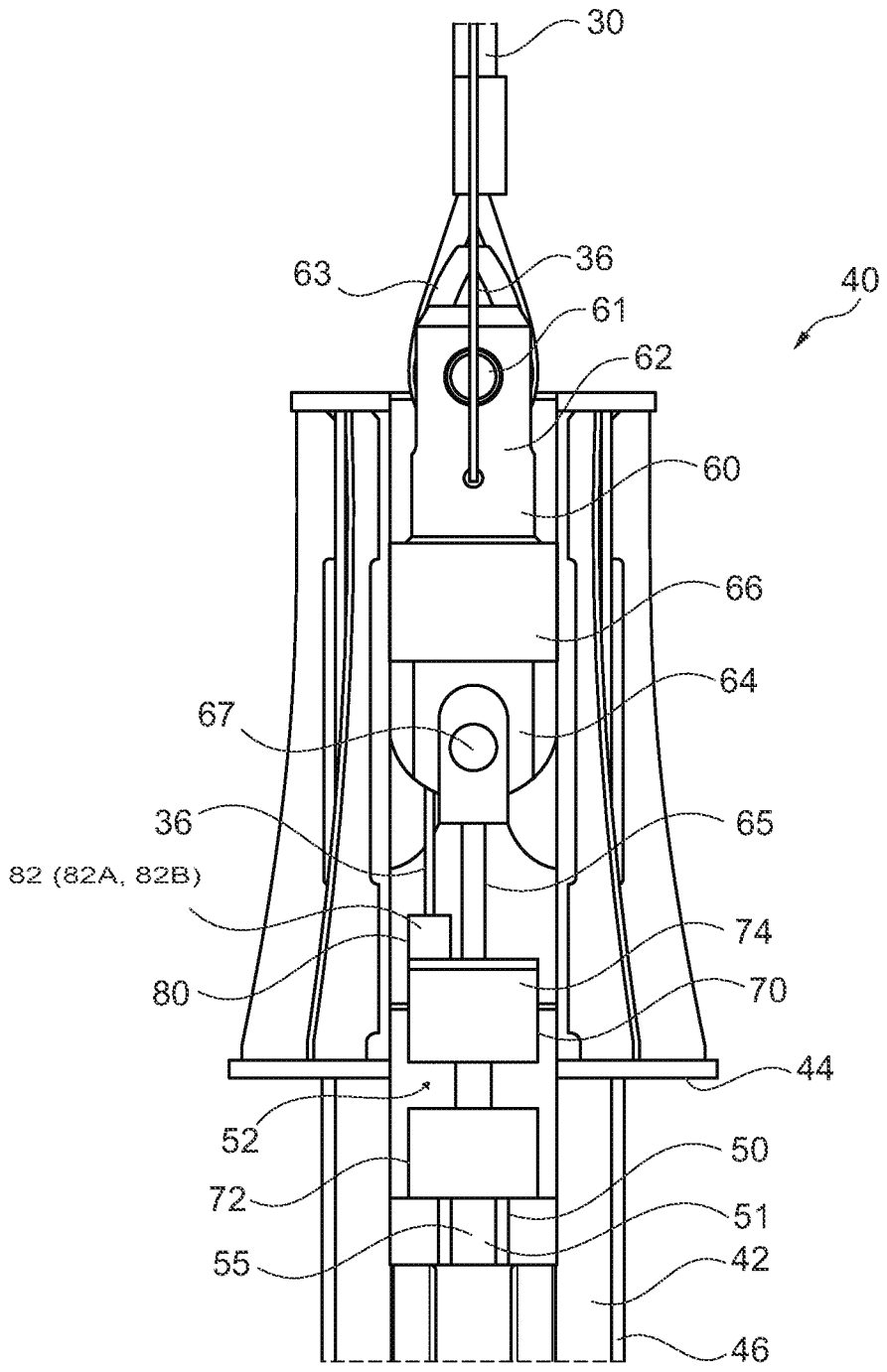

FIG. 4 an enlarged partially cross-sectional illustration of an upper region of the Kelly bar arrangement according to the invention.

A drilling apparatus 10 according to FIG. 1 comprises a crawler-track running gear as undercarriage 12, on which an upper carriage 14 is supported in a rotatable manner. On the upper carriage 14 a substantially vertical mast 20 is linked in a pivotable manner and adjustable with regard to a mast inclination by means of a setting arrangement 18 with hydraulic cylinders. At an upper end of the mast 20 a mast head 22 is mounted, via which a support rope 30 is guided up to a winch 16 on the upper carriage 14.

By means of a rope suspension 60 a Kelly bar arrangement 40 according to the invention is suspended on the support rope 30. The Kelly bar arrangement 40 is guided in a generally known manner through a ring-shaped drill drive 24 which is also referred to as rotary drive head and supported on a sledge 25 in a vertically movable manner along a guide on a front side of the mast 20. At a lower end of the Kelly bar arrangement 40 a ground working tool 26 is mounted which is designed in the illustrated exemplary embodiment as a drilling bucket with lower removal teeth. Via the winch 16 and the support rope 30 the Kelly bar arrangement 40 can be moved in a generally known manner relative to the drill drive 24 in the vertical direction.

The Kelly bar arrangement 40 according to the invention allows the suspension of a ground working tool 26 on a rope while at the same time providing the possibility of transmitting a torque from the drill drive 24 to the ground working tool 26.

The structure of the Kelly bar arrangement 40 according to the invention is explained in greater detail in conjunction with the FIGS. 2 to 4. The illustration of FIG. 3 is rotated by 90° with respect to the illustrations of the FIGS. 2 and 4.

In the illustrated exemplary embodiment the Kelly bar arrangement 40 has an outer Kelly bar 42 with external drive strips 46, an inner Kelly bar 50 with external drive strips 53 and an interposed intermediate Kelly bar 48 with external drive strips 49. The outer Kelly bar 42, the intermediate Kelly bar 48 and the inner Kelly bar 50 are each axially displaceable with respect to each other, wherein, independently of the respective axial set position, the torque can in each case be transmitted in a generally known manner via non-depicted axial internal drive strips from the outer Kelly bar 42 to the intermediate Kelly bar 48 and from this to the inner Kelly bar 50. Furthermore, on the individual bar elements locking recesses can be provided so that in a locked state axial forces can also be transmitted to a certain extent via the Kelly bar arrangement 40.

In an upper region of the outer Kelly bar 42 a sleeve-shaped bearing section 44 with a radial bearing surface is provided, with which the outer Kelly bar 42 and thus the Kelly bar arrangement 40 as a whole can be placed onto the drill drive 24.

The Kelly bar arrangement 40 as a whole is suspended via the inner Kelly bar 50 via a rope suspension 60 on the support rope 30.

In its lower end region 54 a ring-shaped bearing plate 57 is arranged, on which the outer Kelly bar 42 and the intermediate Kelly bar 48 are placed in the retracted state according to FIG. 3. Furthermore, in the lower end region 54 of the inner Kelly bar 50 a connecting means 58 is provided for releasably fixing the ground working tool 26. In the illustrated exemplary embodiment this is a square section with a transversely directed bore for receiving a locking bolt. Moreover, in the lower end region 54 of the inner Kelly bar 50 a damping means 56 can be provided, as depicted in FIGS. 2 and 3. The damping means 56 can serve to dampen axial impacts during inward and outward telescoping of the Kelly bar arrangement 40 or when placing the ground working tool 26 onto the ground.

In its upper end region 52 the inner Kelly bar 50 and thus the entire Kelly bar arrangement 40 is suspended on the support rope 30 by means of the rope suspension 60. As can be seen from FIG. 4 in particular, in the illustrated exemplary embodiment the support rope 30 is provided with a rope eyelet 63 which is connected via a transversely directed retaining bolt 61 to an upper linkage region 62 of the rope suspension 60. A lower linkage region 64 of the rope suspension 60 is connected via a connecting bolt 67 and a connecting piece 65 to the inner Kelly bar 50. Between the upper linkage region 62 and the lower linkage region 64 of the rope suspension 60 a rotary joint is arranged for forming a rope swivel 66. The rotary joint permits a rotation about the longitudinal axis of the rope between the upper linkage region 62 and the lower linkage region 64 to prevent a twisting of the support rope 30 during rotational driving of the drill rod arrangement 40.

In the upper end region 52 of the inner Kelly bar 50 a rotary feedthrough 70, depicted in a highly schematic manner, with a lower first attachment section 72 and an upper second attachment section 74 is arranged. The inner Kelly bar 50 is connected in a torque-proof manner to the lower first attachment section 72 while the upper second attachment section 74 is firmly connected to the connecting piece 65 and the rope suspension 60. The first attachment section 72 and the second attachment section 74 of the rotary feedthrough 70 are rotatably supported with respect to each other and form a line connection.

Here, an upper supply line 36, depicted in a highly schematic manner, is provided which is led in from the drilling apparatus 10 in particular, and more particularly the upper carriage 14, from above the Kelly bar arrangement 40. Here, the rotary feedthrough 70 forms a line connection to a line 55 on the inner Kelly bar 50. In the illustrated exemplary embodiment the line 55 is designed as a fluid line in the hollow space 51 of the tubular inner Kelly bar 50. Here, the supply line 36 can also supply a fluid and, as indicated in the illustrated exemplary embodiment, can also constitute an electricity supply for a rotary means 80 according to the invention with a drive motor 82. Here, the drive motor 82 is arranged on the upper second attachment section 74 of the rotary feedthrough 70 and can rotate this relative to the lower first attachment section 72. For this purpose, a gear wheel arrangement can be provided.

By way of the rotary feedthrough 70 according to the invention with rotary means 80 it is possible that even without firm support of the upper second attachment section 74 a standstill of the upper second attachment section 74 with the supply line 36 can be ensured in particular through a controlled diametrically opposed driving of the drive motor 82 even if the inner Kelly bar 50 with the lower first attachment section 72 of the rotary feedthrough 70 is driven in a rotating manner. A control 82A is provided for the rotary means 80 and a rotation detector 82B is provided for determining a rotational speed and/or a direction of rotation at least of the inner Kelly bar 50.

The Kelly bar arrangement 40 according to the invention with the rotary means 80 therefore ensures a reliable functioning of the rotary feedthrough 70, even if the Kelly bar arrangement 40 is fully telescoped outwards and the rope suspension 60 with the rotary feedthrough 70 and the rotary means 80 is located in a lower region of the intermediate Kelly bar 48.

The invention claimed is:

1. A Kelly bar arrangement for a drilling apparatus, in particular an earth drilling apparatus, with a tubular outer Kelly bar, which is designed for bearing on a drill drive and for receiving a drilling torque of the drill drive, and with an inner Kelly bar, which is displaceably supported inside the outer Kelly bar and has a rope suspension, wherein the drilling torque can be transmitted between the outer Kelly bar and the inner Kelly bar, at least one line is included on the inner Kelly bar, wherein in a lower or upper end region of the inner Kelly bar a rotary feedthrough with a first attachment section and a second attachment section is arranged, wherein the first attachment section is connected to the rotationally drivable inner Kelly bar and forms a line connection to the at least one line of the inner Kelly bar and the second attachment section is connected to a supply line, the supply line being stationary relative to the rotationally drivable inner Kelly bar, wherein on the rotary feedthrough, a rotary device is arranged and includes a drive motor for actively rotating the second attachment section relative to the first attachment section, and the inner Kelly bar is provided with a cable which is designed for conducting electricity and/or data.

2. The Kelly bar arrangement according to claim 1, wherein the rotary feedthrough is arranged on the inner Kelly bar below the rope suspension.

3. The Kelly bar arrangement according to claim 1, wherein the drive motor is arranged on the second attachment section which lies above the first attachment section.

4. The Kelly bar arrangement according to claim 1, wherein the drive motor is an electric motor or a hydraulic motor.

5. The Kelly bar arrangement according to claim 1, wherein the rope suspension has a rope swivel.

6. The Kelly bar arrangement according to claim 1, wherein an axial hollow space of the inner Kelly bar is provided which is designed for passing a fluid through.

7. A drilling apparatus, in particular earth drilling apparatus, with a drill drive, wherein a Kelly bar arrangement according to claim 1 is arranged.

8. The drilling apparatus according to claim 7, wherein a control is provided for the rotary device and a rotation detector is provided for determining a rotational speed and/or a direction of rotation at least of the inner Kelly bar, which is in signal connection with the control.

9. The drilling apparatus according to claim 8, wherein the rotary device is driven in a controlled manner by the control such that the second attachment section of the rotary feedthrough is driven and synchronized in a diametrically opposed manner to a rotating motion of the inner Kelly bar.

10. A method for working the ground with a drilling apparatus according to claim 7, in which a Kelly bar arrangement is set into rotating motion by a drill drive, wherein on an inner Kelly bar of the Kelly bar arrangement a ground working tool is mounted which works a ground, wherein a rotary device is provided for actively rotating the second attachment section relative to the first attachment section, wherein the second attachment section is operated in a diametrically opposed manner to a rotating motion of the inner Kelly bar.

11. The method according to claim 10, wherein the rotary device is operated depending on a rotational speed of the inner Kelly bar or the drill drive.

* * * * *